US007104229B2

(12) United States Patent
Mitchell

(10) Patent No.: US 7,104,229 B2
(45) Date of Patent: Sep. 12, 2006

(54) VARIABLE VALVE TIMING SYSTEM

(76) Inventor: Stephen William Mitchell, 93 Lowercroft Road, Bury (GB) BL8 2ER ( * ) Notice: Subject to any disclaimer, the term of this patent is extended or adjusted under 35 U.S.C. 154(b) by 0 days.

(21) Appl. No.: 10/474,095

(22) PCT Filed: Apr. 2, 2002

(86) PCT No.: PCT/GB02/01280

§ 371 (c)(1),
(2), (4) Date: Mar. 12, 2004

(87) PCT Pub. No.: WO02/081872

PCT Pub. Date: Oct. 17, 2002

(65) Prior Publication Data

US 2004/0139936 A1 Jul. 22, 2004

(30) Foreign Application Priority Data

Apr. 5, 2001 (GB) ..... 0108544.8
Mar. 1, 2002 (GB) ..... 0204934.4

(51) Int. Cl.
*F01L 1/34* (2006.01)

(52) U.S. Cl. ..... 123/90.16; 123/90.15; 123/90.17; 123/90.31; 123/90.18; 74/568 R; 464/102; 464/110

(58) Field of Classification Search .. 123/90.15–90.18, 123/90.27, 90.31, 90.21–90.23; 74/568 R, 74/68; 464/102–105, 110
See application file for complete search history.

(56) References Cited

U.S. PATENT DOCUMENTS 733,220 A * 7/1903 Krebs ..... 74/3
3,491,604 A * 1/1970 Levi ..... 74/63
3,633,555 A 1/1972 Raggi
4,382,428 A * 5/1983 Tourtelot, Jr. ..... 123/90.16
4,505,235 A 3/1985 Mitchell
4,872,428 A 10/1989 Mitchell
4,913,104 A 4/1990 Mills
5,074,260 A 12/1991 Yagi et al.
5,080,055 A 1/1992 Komatsu et al.
5,095,861 A 3/1992 Dove, Jr.
5,152,262 A 10/1992 Parker
5,333,579 A 8/1994 Hara et al.

(Continued)

FOREIGN PATENT DOCUMENTS

DE 4419557 C1 10/1995

(Continued)

*Primary Examiner*—Thomas Denion
*Assistant Examiner*—Kyle M. Riddle
(74) *Attorney, Agent, or Firm*—Woodard, Emhardt, Moriarty, McNett & Henry LLP

(57) ABSTRACT

A variable valve timing system for an internal combustion engine, comprising a drive shaft driven by the engine, a camshaft driven by the drive shaft, and a cam supported by the camshaft for bearing against a valve actuating member. The camshaft and the drive shaft have parallel, spaced apart fixed axes of rotation, and are interconnected by a drive link, one end of which is coupled to the drive shaft and the other end of which is coupled to the camshaft. Means are provided for varying the spacing between an end of the link and the axis of rotation of the shaft to which that end is coupled. The system eliminates the need to move the axis of the central drive shaft, or to move an intermediate member or the camshaft, and also eliminates the need to have a control shaft external to the drive shaft or camshaft. The invention also provides camshaft assemblies and linkages for connecting camshafts and drive shafts.

24 Claims, 3 Drawing Sheets

U.S. PATENT DOCUMENTS

| | | | | | |
|---|---|---|---|---|---|
| 5,363,818 | A | | 11/1994 | Iwata et al. | |
| 5,365,896 | A | | 11/1994 | Hara et al. | |
| 5,373,818 | A | | 12/1994 | Unger | |
| 5,398,649 | A | | 3/1995 | Shimamoto | |
| 5,417,611 | A | * | 5/1995 | Mitchell | 464/102 |
| 5,617,818 | A | | 4/1997 | Luders | |
| 5,787,849 | A | | 8/1998 | Mitchell | |
| 5,899,180 | A | * | 5/1999 | Fischer | 123/90.16 |
| 5,931,129 | A | * | 8/1999 | Nohara et al. | 123/90.17 |
| 5,988,125 | A | * | 11/1999 | Hara et al. | 123/90.16 |
| 6,425,357 | B1 | * | 7/2002 | Shimizu et al. | 123/90.16 |
| 6,427,653 | B1 | | 8/2002 | Hara et al. | |

FOREIGN PATENT DOCUMENTS

| | | | |
|---|---|---|---|
| DE | 10053776 | A1 | 7/2001 |
| FR | 2 305 589 | | 10/1976 |
| GB | 2 066 361 | A | 7/1981 |
| GB | 2 165 885 | A | 4/1986 |
| GB | 2 231 088 | A | 11/1990 |
| WO | WO 02/06642 | A1 | 1/2002 |

* cited by examiner

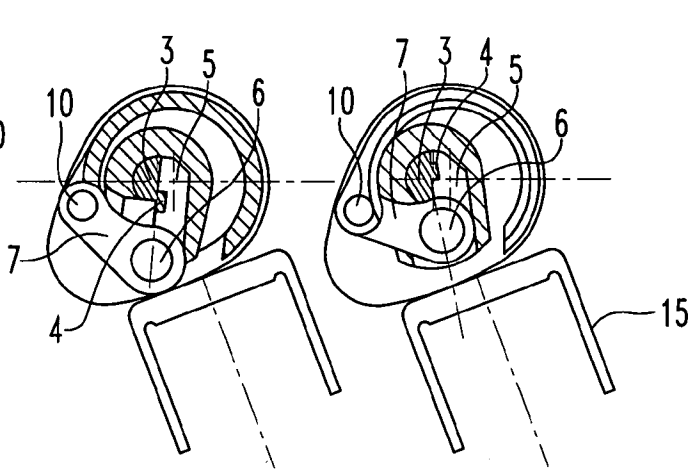
Fig. 5
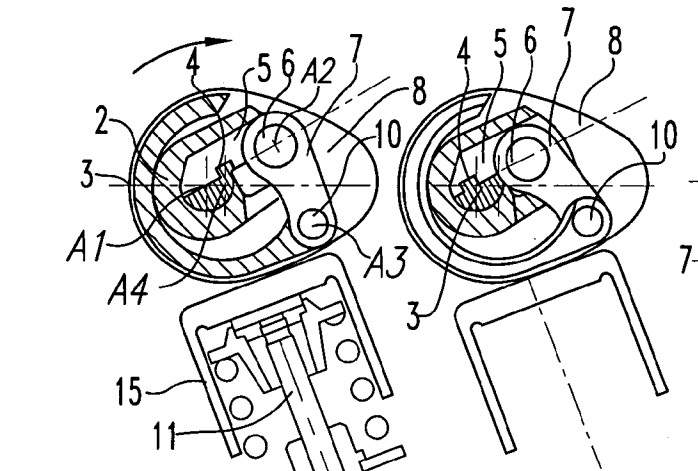
Fig. 4
Fig. 3
Fig. 2
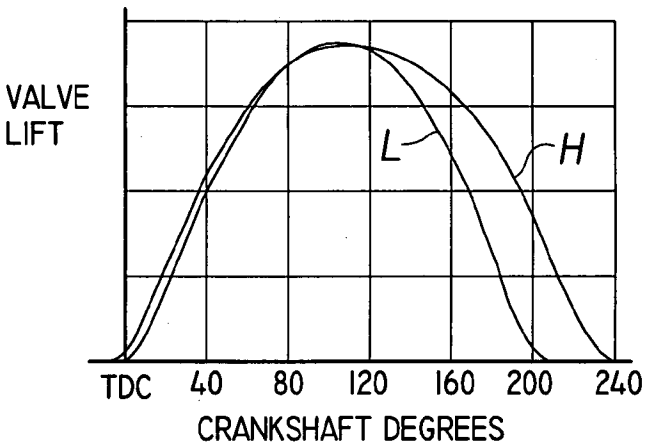
Fig. 6

VARIABLE VALVE TIMING SYSTEM

The present invention relates to a variable valve timing system for use in for example an internal combustion engine.

It is well known to alter the inlet valve timing and, in particular, the inlet valve closing position of an engine in response to changes in speed and load to improve the torque and power output, improve fuel consumption, and improve exhaust emissions. Engine tests have also shown that substantial improvements can be made to idle fuel consumption and exhaust emissions by very early closing of the inlet valve especially if the engine idle speed is lowered simultaneously. The inlet valve should close later at high engine speed to give increased power and this later closing can be accompanied by an advancement of the inlet valve opening. A variable event camshaft can also be fitted to the exhaust valves to extend the expansion stroke at low engine speeds to further improve fuel consumption and further improve low engine speed vehicle drivability. A variable event exhaust camshaft can also advantageously alter the position of exhaust valve closing.

Many camshaft drive mechanisms that provide variable valve timing are known as phase changers. This type of mechanism does not change the duration of valve timing which is known as the event, but simply advances or retards the camshaft relative to the crankshaft to provide overlap control, that is, control of the period during which the inlet and exhaust valves are open together at the commencement of the inlet cycle.

Event changers are camshaft drive mechanisms which do change the duration of valve timing, by altering one or both of the valve opening and closing times, so that the total number of degrees of drive shaft rotation during which the valve is open is altered from for example high engine speed to low engine speed. There are differences in the requirements of valve timing between gasoline engines and diesel engines. In a diesel engine, a substantial change in valve position may only be made to the inlet closing position, as it is necessary to avoid advancement of the inlet opening due to the close valve-to-piston clearances. Even though the change is made to the inlet closing position only, the duration of valve opening changes substantially from low engine speed to high engine speed. In the case of the exhaust valve in a diesel engine, a change to the opening may be made provided that the position of valve closing is not retarded.

Several different types of event changer are available. One system of this type is disclosed in U.S. Pat. No. 4,505,235 and consists of a drive shaft running inside a hollow camshaft. An eccentric linkage connects the drive shaft to the camshaft. When the axis of the drive shaft is moved relative to the axis of the camshaft, the camshaft rotates at variable angular velocity and changes the duration of valve timing.

There are a number of problems with the system shown in U.S. Pat. No. 4,505,235. One problem is a potential problem associated with shaft alignment through a number of movable shaft supports. This arrangement also means that a special chain or belt tensioner is required, or a special seal in the case of a belt driven apparatus. There are also difficulties with engines that use twin overhead camshafts. Some engines with twin overhead camshafts would require a complete redesign of the camshaft drive system to incorporate a variable valve timer as shown in U.S. Pat. No. 4,505,235.

Some types of variable valve timing mechanisms use an intermediate member between the camshaft and drive shaft. This type of system requires two eccentric linkages, one from the drive shaft to the intermediate member and the other from the intermediate member to the camshaft. An example of this type of variable valve timer is shown in U.S. Pat. No. 3,633,555. Increased frictional losses occur with the double eccentric linkage system and also with the bearing supporting the intermediate member. There are also significant cost penalties with such a system.

U.S. Pat. No. 5,787,849 describes a variable valve timing phase changer that is suitable for use with an event changer. As shown in FIG. 6 of U.S. Pat. No. 5,787,849, a hollow camshaft is connected to a driving shaft running through the centre of the camshaft by an eccentric linkage, the eccentricity of the linkage being varied in response to engine speed. At high engine speed, the camshaft and driving shaft are concentric so that the camshaft is driven at the same constant angular velocity as the driving shaft. At low engine speed, the camshaft and driving shaft are eccentric so that the camshaft is driven at variable angular velocity to change the duration of valve timing.

The eccentric linkage described in U.S. Pat. No. 5,787,849 consists of an arm that is integral to the driving shaft and which supports a sliding block that runs in a slot provided in a central part of the camshaft. The machining of a slot is a non preferred machining operation in the automotive industry.

"Block and slot" connections are used, in many variable velocity camshaft mechanisms, not just those having hollow camshafts. U.S. Pat. No. 5,333,579 discloses an arrangement where the driving shaft is connected to an intermediate member by a block and slot eccentric linkage. The intermediate member drives the camshaft via another block and slot linkage. U.S. Pat. No. 5,152,262 also uses a double block and slot system, with a block and slot linkage positioned at the front and rear of the engine to drive camshafts at variable angular velocity. However, double block and slot systems produce significant frictional losses.

It is an object of the present invention to obviate some or all of the problems outlined above.

According to a first aspect of the present invention there is provided a variable valve timing system for an internal combustion engine, comprising a drive shaft driven by the engine, a camshaft driven by the drive shaft and a cam supported by the camshaft for bearing against a valve actuating member, wherein the camshaft and the drive shaft have parallel, spaced apart fixed axes of rotation and are interconnected by a drive link one end of which is coupled to the drive shaft and the other end of which is coupled to the camshaft, means being provided for varying the spacing between an end of the link and the axis of rotation of the shaft to which that end is coupled.

Thus, the variable valve timing system of the present invention eliminates the need to move the axis of the central drive shaft or to move the camshaft.

Preferably, an end of the link is pivotally connected to the camshaft. Preferably an end of the link is pivotally connected to a drive member mounted on and moveable with respect to the drive shaft axis.

Preferably, the drive shaft extends through the camshaft and the drive member is engaged by a control shaft provided in and rotatable with the drive shaft, the drive member being coupled to the control shaft such that a displacement of the control shaft relative to the drive shaft causes a radial movement of the drive member. The drive member is preferably engaged with the control shaft such that axial movement of the control shaft causes the radial movement of the drive member, preferably by means of an inclined key defined by the control shaft, the drive member defining a slot engaged with the inclined key such that axial movement of the control shaft causes the drive member to travel along the inclined key.

The link may be coupled to the drive shaft and camshaft by needle bearings.

As the camshafts and drive shaft are located in fixed bearings, there are no movable members supporting the camshafts or drive shaft. There is also no intermediate member between the camshaft and drive shaft, and therefore no movable members to support such an intermediate member. There is further no separate control shaft that would need to be located and supported parallel to the camshafts and drive shaft. The present invention thus provides a mechanism that is simple, less costly to produce, more compact and more robust than prior art systems.

According to a second aspect of the present invention , there is provided a variable valve timing system comprising at least one camshaft and a drive shaft extending parallel to the camshaft, wherein the camshaft is coupled to the drive shaft by a link one end of which defines at least two spans through which a pin mounted on the camshaft extends, each span being received between a respective pair of pivot pin supports defined by the camshaft Given that each span of the link can be relatively short, relatively low bending stresses are applied to the pin, which means a much smaller pin can be used. The link may be a single member defining all the spans, or two or more members each defining one span.

The reduction in pin diameter also enables the camshaft to be used easily where the cams are designed to activate valve levers and rockers. This is because levers or rockers have a lever ratio such that cam lift is much less than valve lift so that adjustment of the lever pivot point can adjust valve clearance. However, because of the reduced cam lift, the cam nose must be smaller so that there is a reduced space available for the placement of a spindle at the cam nose.

Embodiment of the invention will now be described with reference to the accompanying drawings, in which:

FIG. 2 is a cross-sectional view through one of the camshafts of FIG. 1 and a part-sectional view of an inlet cam acting on a bucket tappet in the valve opening position at high engine speed;

FIG. 3 is a cross-sectional view through one of the camshafts of FIG. 1 and a view of an inlet cam acting on a bucket tappet in the valve opening position at low engine speed;

FIG. 4 is a cross-sectional view through one of the camshafts of FIG. 1 and a part-sectional view of an inlet cam acting on a bucket tappet in the valve closing position at high engine speed;

FIG. 5 is a cross-sectional view through one of the camshafts of FIG. 1 and a view of an inlet cam acting on a bucket tappet in the valve closing position at low engine speed;

FIG. 6 is a graph of valve lift plotted against crankshaft degrees for an inlet valve;

Figure 1:
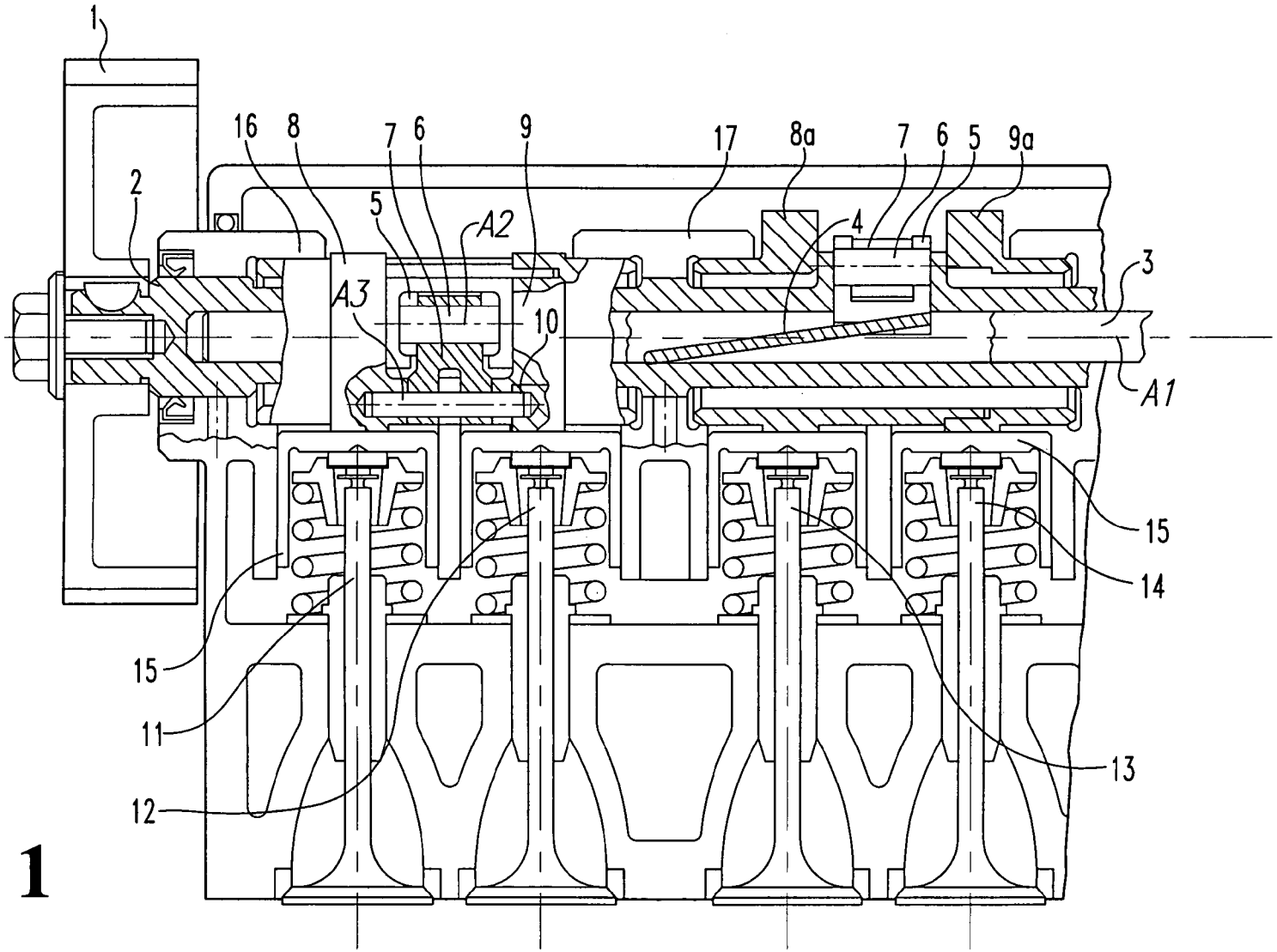
FIG. 1 is a partial cross-sectional view of a cylinder head incorporating a variable valve timing system in accordance with the present invention.
Figure 9:
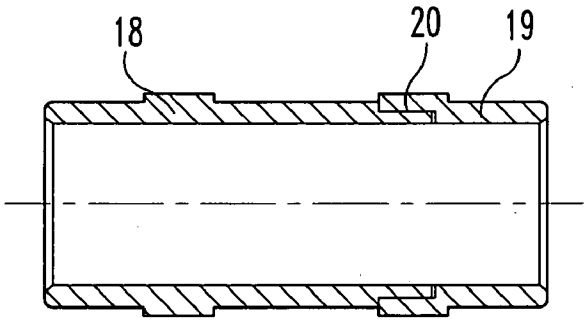
FIG. 9 illustrates an alternative camshaft structure to that of FIGS. 7 and 8.
Figure 7:
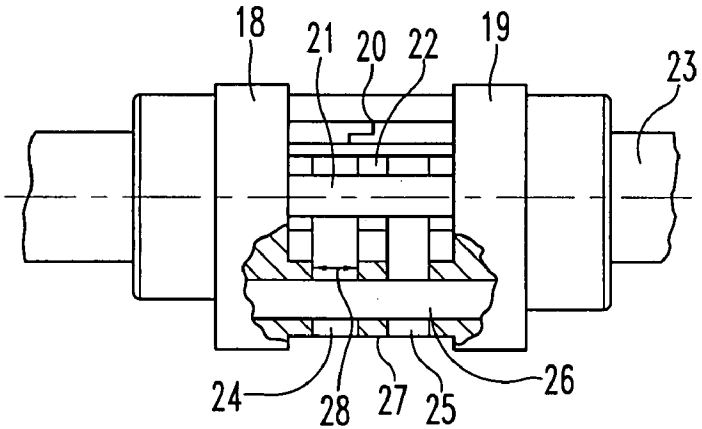
FIG. 7 illustrates an alternative link arrangement to that shown in FIG. 1.
Figure 8:
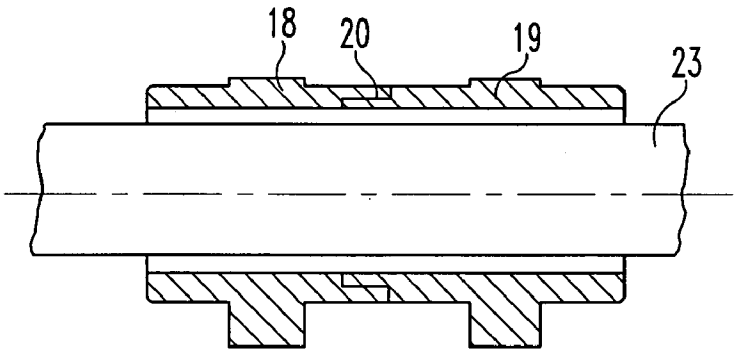
FIG. 8 is a section through a camshaft shown in FIG. 7, also showing a drive shaft extending through the camshaft.

Referring to FIGS. 1 and 2, a cylinder head is illustrated, and has many conventional features which it is considered do not need detailed description since they are well understood by persons skilled in the art. A pulley 1 is driven by an engine crankshaft by means of a belt or chain (not shown). The pulley 1 is attached to a hollow drive shaft 2 having an axis A1 and a control shaft 3 in its centre. An inclined key 4 is machined in the control shaft 3 and is engaged with a slot in a drive block 5 which carries a pin 6 that is attached to one end of a link 7. The axis A2 of pin 6 is parallel to the axis A1 of drive shaft 2. The other end of link 7 is attached between two cams 8 and 9 by means of a pin 10 having an axis A3. One set of cams 8 and 9 (and hence drive blocks 5, links 7 etc) is provided above valves 11 and 12, and another set of cams 8*a* and 9*a* is provided above valves 13 and 14. A bucket tappet 15 is provided on each valve to provide a cam actuating surface. The set of cams 8 and 9 above valves 11 and 12 are placed at a different rotational position around the drive shaft 2 to the other set of cams 8*a* and 9*a* above valves 13 and 14. Cams 8*a* and 9*a* will not be further described, as they are identical to cams 8 and 9.

Drive shaft 2 is supported on fixed bearings 16 and 17, the bearings being split along the horizontal centreline. A control cylinder (not shown) is connected to control shaft 3 via a thrust race (not shown) to enable longitudinal movement of control shaft 3 within the hollow centre of drive shaft 2. The cylinder head and split caps are also machined to provide bearings for the camshafts.

Cams 8 and 9 are spigotted together and form a camshaft that is provided around drive shaft 2, the pin 10 preventing relative movement of the cams. In addition, cams 8 and 9 could have a further screw or rivet to supplement pin 10. The cams are preferably produced by sintering, and may be electron beam welded together. The material and method of machining the cams is dependent on the type of cam follower used.

In the case of cams operating rockers or levers with curved pads or bucket tappets with curved or flat tops, the cams are made from a material suitable for nitride hardening. After the cams are spigotted together and electron beam welded, the bearing journals end the cam profiles are ground, holes in the cam sides are machined and then the cams are nitride hardened.

In the case of cams designed to operate valve levers with hardened roller followers, the cams are made from a material suitable for case hardening. Each cam is in this instance initially carburized only, then a machining operation is used to remove the carbon from the sides of the cam. The spigot diameter is then machined, which removes carbon from the area of electron beam welding. The two cams are then spigotted together and electron beam welded. After electron beam welding the cams are reheated and quenched. Finally, the cam bearing journals and cam profiles are ground and the holes in the sides of the cams are machined.

The link 7 may be a one-piece link member, or may be two individual link members, or a hybrid link as shown. The link could be made from sintered iron or an SG iron precision casting and could run on a pin which was nitride hardened. As oil would be coming out of the camshaft bores, the underside of the link could have oil drillings into the link bores. Such a material combination with oil lubrication would give long life especially having regard to the load and angular movement of the link cycle.

The camshaft defined by cams 8 and 9 is supported in fixed bearings such that its axis A4 is offset or eccentric relative to the longitudinal axis A1 of the drive shaft 2. Axial movement of the control shaft 3 causes block 5 to travel along inclined key 4, thus moving the end of link 7 that is attached to block 5 via pin 6 nearer to or further away from the drive shaft axis A1. As the axes A4 of the camshafts and A1 of the drive shaft are offset, this causes a variation in angular velocity of the camshaft during each rotation with respect to the angular velocity of the drive shaft. The maximum variation in camshaft angular velocity occurs when the end of link 7 attached to block 5 is nearest to the axis of rotation of the drive shaft, and this occurs at low engine speed. The minimum variation in camshaft angular velocity occurs when the end of link 7 attached to block 5 is furthest away from the centre of the drive shaft axis, which occurs at high engine speed, and when the cam is profiled to give the correct high speed trajectory to the valve when the link is in this position.

Referring now to FIGS. 2 to 5, cams 8 are shown in a variety of configurations. Cams 9 are mirror images of cams 8 and will not be further described. FIGS. 2 and 3 show an inlet cam at its valve open position at high and low engine speed positions respectively. It can be seen that in the high engine speed position (FIG. 2), drive block 5 has been moved radially outwardly by means of the axial movement of control shaft 3, thus causing the end of link 7 attached to drive block 5, and hence axis A2, to be moved further from the axis of rotation of the camshaft and the drive shaft 2. In the low engine speed position (FIG. 3), drive block 5 has been moved radially inwardly by means of control shaft 3. FIGS. 4 and 5 are similar to FIGS. 2 and 3, and show the inlet cam at its valve closing position at high and low engine speeds.

FIG. 6 shows a diagram of valve lift for an inlet valve plotted against crankshaft degrees for a gasoline engine. Curve H shows the high engine speed results and curve L shows the low engine speed results. At high engine speed, with the end of link 7 that is attached to block 5 in the maximum radially outwards position, the inlet valve is opened at 12° BTDC (before top dead centre) and is closed at 60° ABDC (after bottom dead centre). At low engine speed, with the end of link 7 attached to block 5 in the minimum radial position, the inlet valve is opened at 4° BTDC and is closed at 19° ABDC. In the case of an exhaust valve, a greater range of variation in timing will be given to the valve opening.

The cam profile may be profiled to give the correct valve trajectory at high engine speed with the cam rotating at the variable angular velocity produced with the block 5 at its furthest distance from the centre of the drive shaft. It should be noted that an increase in cam nose speed is caused during the opening and closing of the valve when the end of link 7 attached to block 5 is furthest away from the centre of the drive shaft. This does not, however, give a reduction in cam life. The reason for this is that as this is an event timing changer, the duration of valve timing is increased to match the highest operating speed of the engine, and if the valve lift is either kept the same or increased slightly compared to a conventional fixed timing camshaft, then the valve accelerations can be decreased. This lowers the maximum loads and lowers the valve spring loads which compensates for the increase in cam speed. As an example, a timing of IO (inlet opening) 4° BTDC IC (inlet closing) 52° ABDC with a fixed timing camshaft is altered to IO 12° BTDC IC 60° ABDC at maximum engine speed with the variable camshaft. Another advantage of the variable speed cam is that the cam nose radius is increased over prior art devices and this lowers the cam nose contact stress.

As the engine speed is increased, and hence the camshaft driving torque is increased, the end of link 7 attached to block 5 is moved to a larger radius position, thus reducing the load acting on the link bearings. The reduction in load means that needle bearings may be used in this end of link 7. The needles in such a bearing would rotate in one direction when under load so that oscillation takes place when the cam is not under load, i.e. when it is operating inlet valves only or exhaust valves only. The driving shaft eccentricity and other link parameters and the range of timing given by these parameters are based on very low pressure× velocity (PV) figures for the link mechanism at all engine speeds up to a maximum during the opening flank and nose periods and lower PV figures during the valve closing flank and nose periods.

It should be noted that the design shown in FIG. 1 is for the invention applied to an engine with the cylinders in-line and with the camshaft drive at the front of the engine. For this reason, the central driveshaft runs through the bores of hollow camshafts. The invention can be applied to different configurations of engines such as a single cylinder engine. In this case the camshaft could be solid, and the drive member, which would be a sprocket fixed parallel to the camshaft but offset. The sprocket would be connected to the camshaft by an eccentric linkage. With such a design the control shaft could go through the bore of the sprocket assembly to move the link radially. It should also be noted that in such a design the link which is attached to the camshaft could be moved radially to vary the valve timing. In this case the camshaft could be made hollow but it would be hollow to receive the control shaft and not any drive shaft. Variations on this design could be made for multi cylinder engines where the drive arrangement is through the centre of the engine as in motor cycle engine design.

The design shown uses a link to drive the camshafts from a drive member. The invention also can use a block mounted an a pin with the block in a slot in the other member. In this case the centre of the block would be moved radially to vary the valve timing. Both the link design and the block design could use a solid shaft moved axially to move the link or block radially. The solid shaft would have an angled surface to move the link or block radially. The drive pulley or sprocket would be located axially in this case.

It should be noted that there are a number of commercial phase changers on the market whereby axial movement of a piston or control rod causes rotational movement of the camshaft sprocket or pulley by a helix mechanism. The axial movement of control rod 3 in FIG. 1 can also actuate one of these mechanisms to combine phase change with the duration change shown in FIG. 6.

In the system illustrated in FIG. 1, the link 7 is a one-piece member defining two spaced apart spans through which the pin 10 extends. The pin 10 is received at each of its ends in a pivot pin support bore defined by the camshaft and passes through a central pivot pin support located between the two spans of the link. Such an arrangement makes it possible to use relatively small spans to achieve relatively low pin bending stresses. This in turn makes it possible to use a relatively small diameter pin.

The invention claimed is:

1. A variable valve timing system for an internal combustion engine, comprising a drive shaft driven by the engine, a camshaft driven by the drive shaft, and a cam supported by the camshaft for bearing against a valve actuating member, said cam being adapted and configured to rotate more than 360 degrees during operation, wherein the camshaft and the drive shaft have parallel, spaced apart fixed axes of rotation and are interconnected by a drive link one end of which is coupled to the drive shaft and the other end of which is coupled to the camshaft, means being provided for varying the spacing between an end of the link and the axis of rotation of the shaft to which that end is coupled.

2. A system according to claim 1, wherein an end of the link is pivotally connected to the camshaft.

3. A system according to claim 1, wherein an end of the link is pivotally connected to a drive member mounted on and moveable with respect to the drive shaft axis.

4. A system according to claim 3, wherein the drive shaft extends through the camshaft and the drive member is engaged by a control shaft provided in and rotatable with the drive shaft, the drive member being coupled to the control shaft such that a displacement of the control shaft relative to the drive shaft causes a radial movement of the drive member.

5. A system according to claim 4, wherein the drive member is engaged with the control shaft such that axial movement of the control shaft causes the radial movement of the drive member.

6. A system according to claim 5, wherein an inclined key is defined by the control shaft, the drive member defining a slot engaged with the included key such that axial movement of the control shaft causes the drive member to travel along the inclined key.

7. A system according to claim 1, wherein the link is coupled to the drive shaft and camshaft by needle bearings.

8. A system according to claim 1, wherein the camshaft is defined by two sub-assemblies that are connected to each other.

9. A system according to claim 8, wherein the sub-assemblies are connected to each other by means of a spigot.

10. A system according to claim 8, wherein the sub-assemblies are welded together.

11. A system according to claim 8, wherein at least one pin extends between the sub-assemblies.

12. A system according to claim 11, wherein the pin forms a pivot for the link.

13. A variable valve timing system for an internal combustion engine, comprising:

a drive shaft driven by the engine, a crankshaft driven by the drive shaft, and a cam supported by the camshaft for bearing against a valve actuating member, said cam being adapted and configured to rotate more than 360 degrees during operation, wherein the camshaft and the drive shaft are interconnected by a drive link having two ends, one end of which is coupled to one of said drive shaft or said camshaft by needle bearings and the other end of which is coupled to the other of said drive shaft or said camshaft;

wherein the relative motion between the one end of the link and the one of the drive shaft or camshaft is oscillatory.

14. The system according to claim 13, which further comprises means for varying the spacing between an end of the link and the axis of rotation of the shaft to which that end is coupled.

15. A system according to claim 13 wherein the other end of the link is coupled to the other of the said drive shaft or said camshaft by needle bearings.

16. A system according to claim 15 wherein the relative motion between the one end of said link and the one of said drive shaft or said camshaft is oscillatory, and the relative motion between the other end of the link and the other of said drive shaft or said camshaft is oscillatory.

17. A system according to claim 13, wherein the drive shaft extends through the camshaft and the drive member is engaged by a control shaft provided in and rotatable with the drive shaft, the drive member being coupled to the control shaft such that a displacement of the control shaft relative to the drive shaft causes a radial movement of the drive member.

18. A system according to claim 17, wherein the drive member is engaged with the control shaft such that axial movement of the control shaft causes the radial movement of the drive member.

19. A system according to claim 18, wherein an inclined key is defined by the control shaft, the drive member defining a slot engaged with the inclined key such that axial movement of the control shaft causes the drive member to travel along the inclined key.

20. A system according to claim 13, wherein the camshaft is defined by two sub-assemblies that are connected to each other.

21. A system according to claim 20, wherein the sub-assemblies are connected to each other by means of a spigot.

22. A system according to claim 20, wherein the sub-assemblies are welded together.

23. A system according to claim 20, wherein at least one pin extends between the sub-assemblies.

24. A system according to claim 23, wherein the pin forms a pivot for the link.

* * * * *